US007459840B2

(12) United States Patent
Pyun et al.

(10) Patent No.: US 7,459,840 B2
(45) Date of Patent: Dec. 2, 2008

(54) SHADOW MASK FOR CATHODE RAY TUBE (CRT)

(75) Inventors: Do-Hun Pyun, Suwon-si (KR); Soon-Dong Jeong, Suwon-si (KR); Soon-Cheol Shin, Suwon-si (KR); Hoo-Deuk Kim, Suwon-si (KR); Mun-Seong Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 106 days.

(21) Appl. No.: 11/377,379

(22) Filed: Mar. 17, 2006

(65) Prior Publication Data

US 2006/0232182 A1 Oct. 19, 2006

(30) Foreign Application Priority Data

Apr. 15, 2005 (KR) ..... 10-2005-0031389

(51) Int. Cl.
*H01J 29/80* (2006.01)

(52) U.S. Cl. ..... 313/403; 313/402

(58) Field of Classification Search ..... 313/402, 313/403

See application file for complete search history.

(56) References Cited

U.S. PATENT DOCUMENTS 3,652,895 A * 3/1972 Tsuneta et al. ..... 313/403
3,882,347 A * 5/1975 Suzuki et al. ..... 313/403
4,168,450 A * 9/1979 Yamauchi et al. ..... 313/403
4,429,028 A * 1/1984 Kuzminski ..... 313/403
5,280,215 A * 1/1994 Ohtake et al. ..... 313/403
6,670,081 B2 12/2003 Laidig et al.
6,803,710 B1 * 10/2004 Ikegami et al. ..... 313/402
7,181,707 B2 2/2007 Kotani et al.

FOREIGN PATENT DOCUMENTS

| | | |
|---|---|---|
| JP | S55-159545 | 12/1980 |
| JP | S56-156636 | 12/1981 |
| JP | H01-175148 | 7/1989 |
| JP | H01-320738 | 12/1989 |
| KR | 1992-0010719 | 6/1992 |

* cited by examiner

*Primary Examiner*—Peter Macchiarolo
(74) *Attorney, Agent, or Firm*—Robert E. Bushnell, Esq.

(57) ABSTRACT

A shadow mask for a Cathode Ray Tube (CRT) which achieves a high brightness and white uniformity by minimizing light emission of incorrect colors, includes: an effective screen portion with a plurality of beam passage holes arranged in a predetermined pattern and a non-holed portion surrounding the effective screen portion with no beam passage holes. The beam passage holes have a large-sized hole portion on a side facing a panel of the CRT and a small-sized hole portion that is smaller than the large-sized hole portion on a side facing an electron gun are selected such. A concave portion is formed on each of the beam passage holes arranged in a direction from a center of the effective screen portion to a direction of emission, and the concave portion is varied from the center of the effective screen portion diagonally such that a serif width D satisfies D=a−bx+cx2 (wherein a, b, and c are constants, and x is a spatial distance from the center of the effective screen portion to the center of the beam passage hole) and a, b, and c are selected such that {c/(b+c)} has an absolute value between 0.0092 and 0.0099.

7 Claims, 11 Drawing Sheets

SHADOW MASK FOR CATHODE RAY TUBE (CRT)

CLAIM OF PRIORITY

This application makes reference to, incorporates the same herein, and claims all benefits accruing under 35 U.S.C. § 119 from an application for SHADOW MASK FOR CATHODE RAY TUBE earlier filed in the Korean Intellectual Property Office on the 15 Apr. 2005 and there duly assigned Serial No. 10-2005-0031389.

BACKGROUND OF THE INVENTION

1. Field of the Invention

The present invention relates to a shadow mask for a Cathode Ray Tube (CRT), and more particularly, to a shadow mask for a CRT which can improve the brightness and the white uniformity and minimize the light emission of incorrect colors.

2. Description of the Related Art

Generally, a Cathode Ray Tube (CRT) is an electronic tube where electron beams emitted from an electron gun are deflected due to a deflection magnetic field, pass through a color selection shadow mask, and then strike and excite green, blue, and red phosphors on a phosphor film within a panel, thereby displaying desired images.

The shadow mask has a color selection function of selecting the emitted electron beams and landing them on the phosphor film. For this purpose, beam passage holes are arranged at the shadow mask in a predetermined pattern to pass the electron beams.

The beam passage holes of the shadow mask are formed in the shape of a circle or a rectangle. When the beam passage holes are formed in the shape of a rectangle, the beam passage holes are arranged such that the long sides of the beam passage holes are parallel to the vertical direction of the shadow mask. The beam passage holes are disposed between bridge portions.

The beam passage holes are formed using a photo etching technique such that the etching is made at both surfaces of the shadow mask. That is, a photoresist is coated onto both surfaces of the shadow mask material, and a pair of disks patterned to correspond to the beam passage holes to be formed are tightly adhered to the photoresist films, followed by exposing the material to light and developing it to form photoresist patterns corresponding to those of the disks. The shadow mask material with the photoresist patterns is etched at both surfaces thereof to thereby form the beam passage holes.

A beam passage hole as described above is formed with a small size on one surface of the shadow mask, and with a large size on the other surface of the shadow mask, and the shadow mask is installed in such a way that the small-sized hole is toward the electron gun and the large-sized hole is toward the panel.

Even if the four corners of the disk which is patterned corresponding to the beam passage holes are formed at an exact right angle to form an exact rectangular pattern of the beam passage hole, the four corners of the shadow mask are formed in the shape of an almost circular arc due to unclear developing of the photoresist pattern, the difference of the etching rates, and other reasons.

Accordingly, the light emission pattern of the phosphors which receive the electron beams is not the exact shape of a rectangle, and the brightness and the white uniformity of the CRT are deteriorated due to the distortion of the pattern.

When the beam passage hole is formed by etching from both of the surfaces of the shadow mask, a boundary portion is formed between the large-sized hole and the small-sized hole. The boundary portion has the shape of a protrusion to the inside of the hole.

Since the electron beams which are emitted from the electron gun pass through the shadow mask almost vertically with respect to the surface of the shadow mask, they land on the phosphors corresponding to the beam passage hole exactly in the middle of the shadow mask.

But in the corner of the shadow mask, the electron beams are deflected so much that parts of the electron beams collide with the boundary portion or the inner surface of the beam passage hole. Accordingly, the electron beams do not land on the phosphors exactly corresponding to the beam passage hole but rather they land on the incorrect phosphors or a black matrix.

Accordingly, light emission of incorrect colors occurs, and the purity of the color and the contrast of the CRT are deteriorated.

In the shadow mask according to the prior art, a bulging portion or a concave portion is formed by extending parts of the beam passage hole toward the bridge portion to solve this problem. This is described in Korean Patent No. KR1992-10719, and Japanese Patent Nos. JP1-175148, JP1-320738, JP55-159545, and JP56-156636.

But if the bulging portion is too large, the shape of the electron beams passing through the beam passage hole also becomes large. Accordingly, not only the phosphors corresponding to the beam passage hole but also incorrect phosphors can emit light.

On the other hand, if the bulging portion is too small, it is hard to prevent the electron beams from colliding with the inner surface of the beam passage hole.

Accordingly, determining the size of the bulging portion properly is extremely important, but there has been no disclosure regarding this factor in the prior art.

Recently, the deflection angle has increased to more than 110 degrees for slim CRTs, and the size of the bulging portion is more important in these CRTs as the deflection angle is increased.

SUMMARY OF THE INVENTION

It is an object of the present invention to provide a shadow mask for a Cathode Ray Tube (CRT) which can improve brightness and white uniformity and minimize light emission of incorrect colors.

This and other objects may be achieved by a shadow mask for a CRT with the following features.

A shadow mask for a CRT according to the exemplary embodiment of the present invention includes an effective screen portion with a plurality of beam passage holes arranged in a predetermined pattern, and a non-holed portion surrounding the effective screen portion with no beam passage holes. The beam passage holes have a large-sized hole portion on the panel side, a small-sized hole portion that is smaller than the large-sized hole portion on the side of the electron gun, and a concave portion having the shape of a circular arc formed on each of the beam passage holes arranged in the direction from the center of the effective screen portion in the direction of emission.

The beam passage holes have almost a rectangular shape, and the long side portions of the beam passage holes are parallel to the vertical line of the effective screen portion.

The concave portion can be formed only on the small-sized hole portion or both on the small-sized hole portion and the large-sized hole portion.

The concave portion is formed to be varied from the center of the effective screen portion diagonally such that serif width D satisfies $D=a-bx+cx^2$ (wherein a, b, and c are constants, and x is a spatial distance from the center of the effective screen portion to the center of the beam passage hole), and a, b, and c are selected such that $\{c/(b+c)\}$ has an absolute value between 0.0092 and 0.0099.

With this structure, the shadow mask for a CRT can improve brightness and white uniformity by minimizing light emission of incorrect colors.

BRIEF DESCRIPTION OF THE DRAWINGS

A more complete appreciation of the present invention and many of the attendant advantages thereof will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

The present invention is described more fully hereinafter with reference to the accompanying drawings, in which exemplary embodiments of the present invention are shown.

Figure 1:
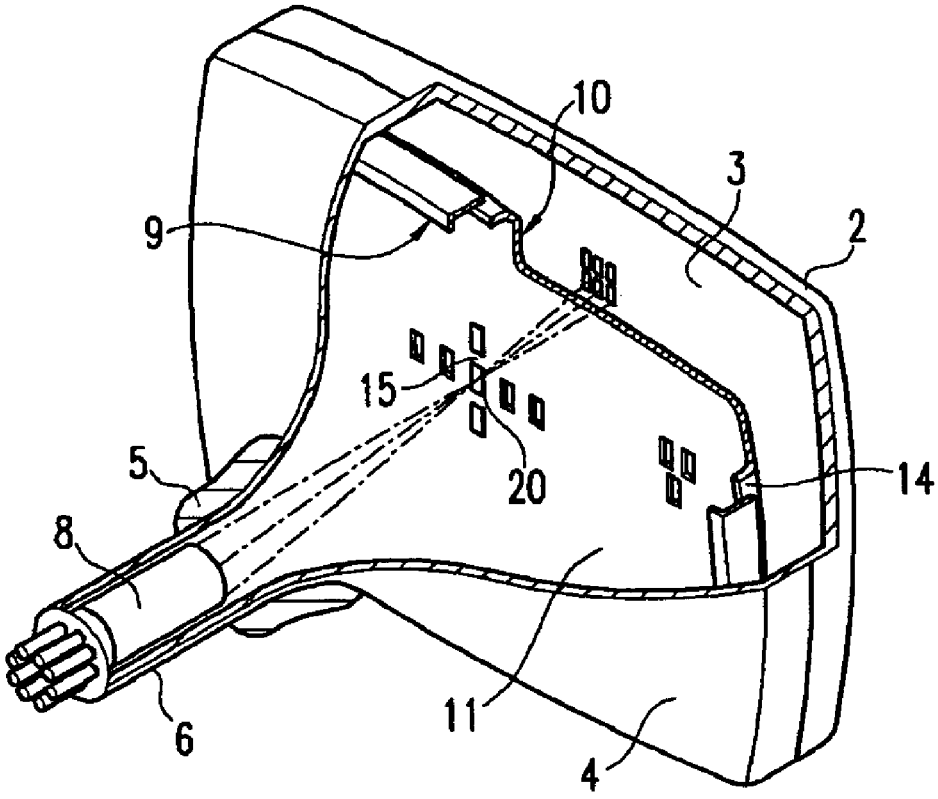
FIG. 1 is a perspective view of a Cathode Ray Tube (CRT) with a shadow mask according to a first embodiment of the present invention.
Figure 2:
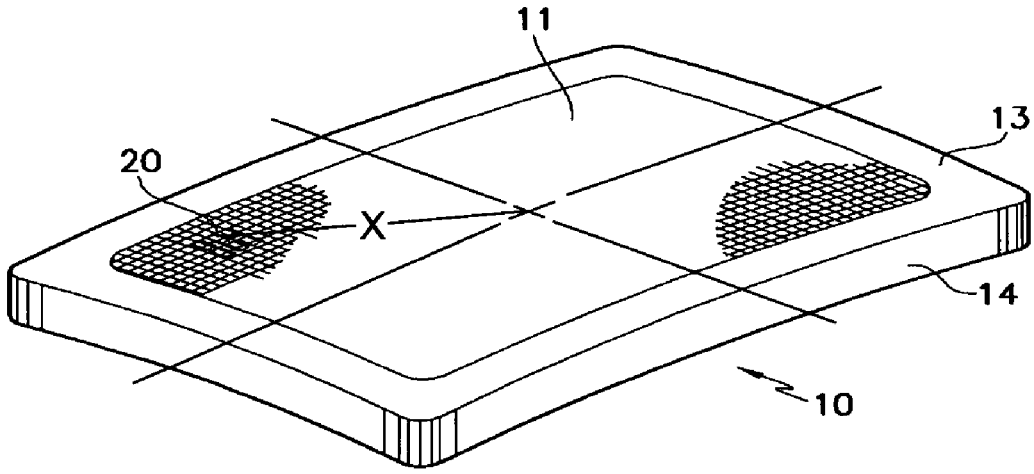
FIG. 2 is a perspective view of the shadow mask for a CRT according to the first embodiment of the present invention.

As shown in FIG. 1 and FIG. 2, a Cathode Ray Tube (CRT) with a shadow mask according to a first embodiment of the present invention includes a vacuum vessel having a panel 2, a funnel 4, and a neck 6, and an electron gun 8. A deflection yoke 5 is arranged on the vacuum vessel.

A phosphor film 3 is formed on an inner surface of the panel 2 with red R, green G, and blue B phosphors patterned while interposing a black matrix BM.

The electron gun 8 is contained within the neck 6 to emit electrons, and the deflection yoke 5 is arranged around an outer circumference of the funnel 4 to deflect the electron beams emitted by the electron gun 8.

The panel 2, the funnel 4, and the neck 6 are integrated into one body to form a vacuum vessel.

A shadow mask 10 is installed in the panel 2 such that it is spaced apart from the phosphor film 3 by a predetermined distance while being supported by a frame 9.

As shown in FIGS. 1 and 2, a plurality of beam passage holes 20 are formed in the shadow mask 10 with a predetermined pattern to pass the electron beams.

In addition, the shadow mask 10 has an effective screen portion 11 having beam passage holes 20 and to display the desired images, and a non-holed portion 13 having no beam-passage holes 20 and not displaying the images.

A bridge portion 15 is disposed between the beam passage holes 20 to sustain the strength and shape of the shadow mask.

The effective screen portion 11 is completely surrounded by the non-holed portion 13. That is, the non-holed portion 13 surrounds the effective screen portion 11 as a rim.

The shadow mask 10 has a skirt portion 14 bent from the edge of the non-holed portion 13 toward the frame 9 to fix the shadow mask 10 to the frame 9.

Within the CRT, the electron beams emitted by the electron gun 8 are deflected due to the deflection magnetic field of the deflection yoke 9, and pass through the beam passage holes 20 of the color selection shadow mask 10. The electron beams then collide with the green, blue, and red phosphors of the phosphor film 3 formed on the inner surface of the panel 2. Consequently, the phosphors are excited to thereby display the desired images.

Figure 3:
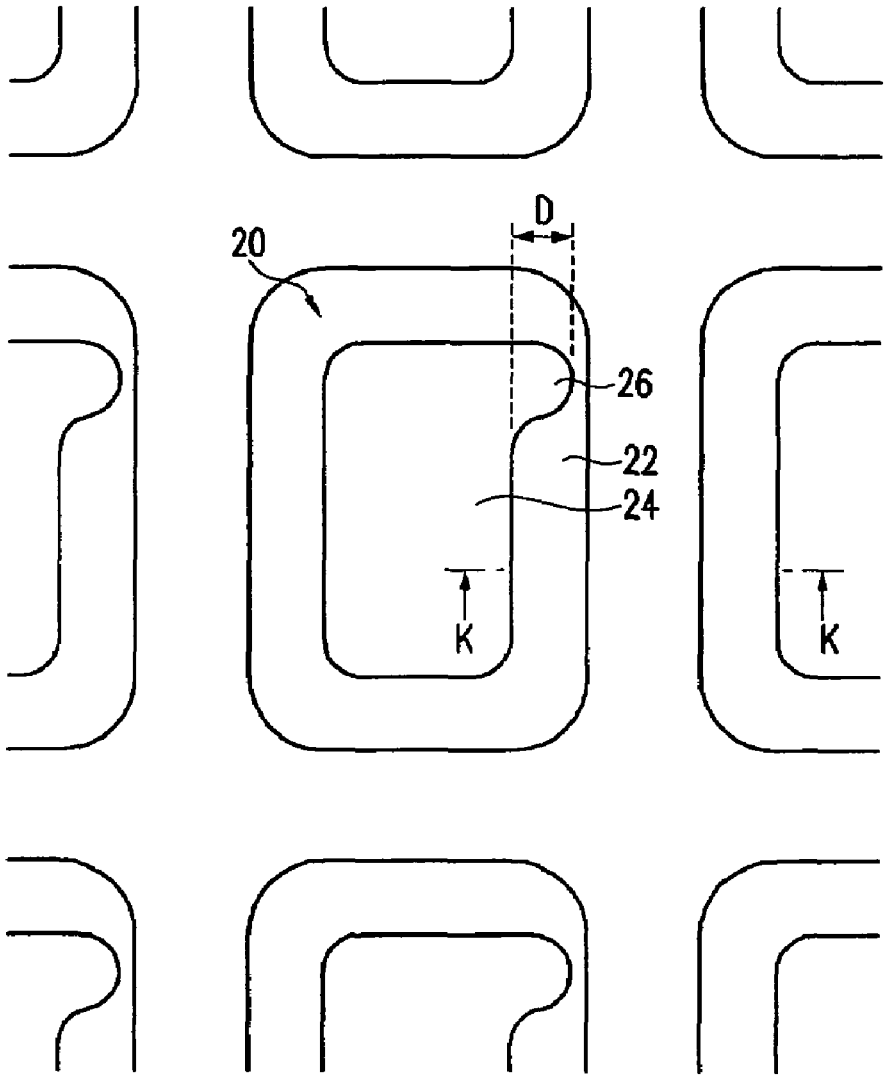
FIG. 3 is a planar view of parts of the fourth quadrant of the shadow mask according to the first exemplary embodiment of the present invention.
Figure 4:
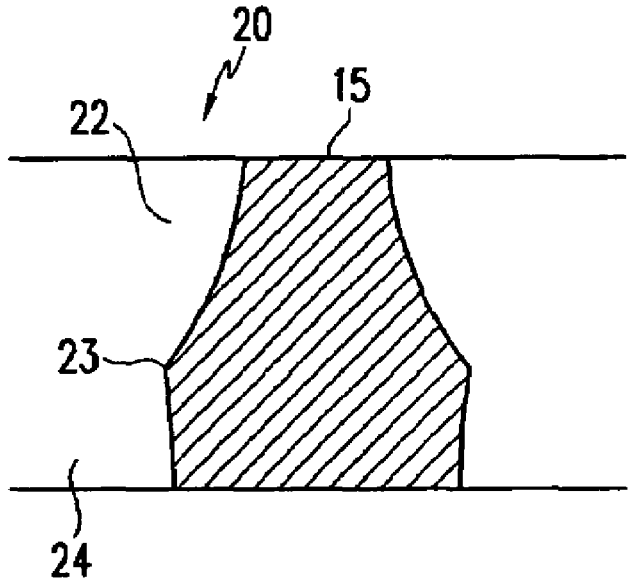
FIG. 4 is a sectional view of FIG. 3 with respect to the line K-K.

As shown in FIGS. 3 and 4, the beam passage hole 20 has a large-sized hole portion on the panel 2 side, and a small-sized hole portion on the electron gun 8 side.

As shown in FIG. 4, in the case that the beam passage hole 20 has the large-sized hole portion 22 and the small-sized hole portion 24, a boundary line 23 is formed in the shape of a protrusion between the large-sized hole portion 22 and the small-sized hole portion 24.

A concave portion 26 with the shape of a circular arc is formed on each of the beam passage holes 20 by eliminating the corner of the beam passage hole 20 which is located from the center of the effective screen portion 11 to the direction of emission.

The beam passage holes 20 have almost a rectangular shape, and the long side portion of the beam passage hole 20 is parallel to the vertical line of the effective screen portion 1.

The concave portion 26 can be formed on only the small-sized hole portion 24 or on both the small-sized hole portion 24 and the large-sized hole portion 22.

As shown in FIG. 3, the concave portion 26 is varied from the center of the effective screen portion 11 diagonally such that the serif width D, that is, the vertical distance from the edge of the long side of the small-sized hole portion 22 to the farthest part of the concave portion 26, approximately satisfies $D=a-bx+cx^2$ (wherein a, b, and c are constants, and x is a spatial distance from the center of the effective screen portion 11 to the center of the beam passage hole 20), and a, b, and c are selected such that $\{c/(b+c)\}$ has an absolute value of from 0.0092 to 0.0099.

The position where the concave portion 26 is formed corresponds to that of the beam passage hole 20 when the effective screen portion 11 is divided into quadrants.

Figure 5:
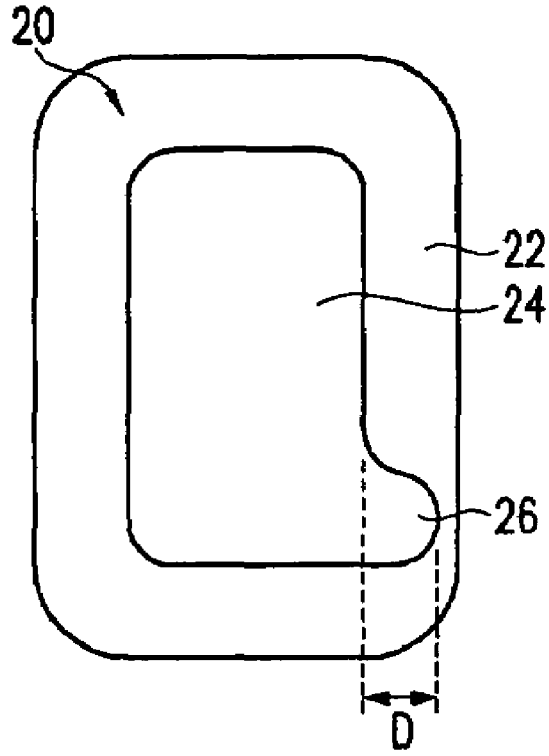
FIG. 5 is a planar view of parts of the first quadrant of the shadow mask according to the first exemplary embodiment of the present invention.

For example, for the beam passage hole 20 located on the fourth quadrant, the concave portion 26 is formed on the top right portion as shown in FIG. 3, and for the beam passage hole 20 located on the first quadrant, the concave portion 26 is formed on the bottom right portion as shown in FIG. 5.

Although not shown in the drawings, for each of the second and the third quadrants, the concave portion 26 is respectively formed on the bottom left and top left portion of the beam passage hole 20.

Figure 6:
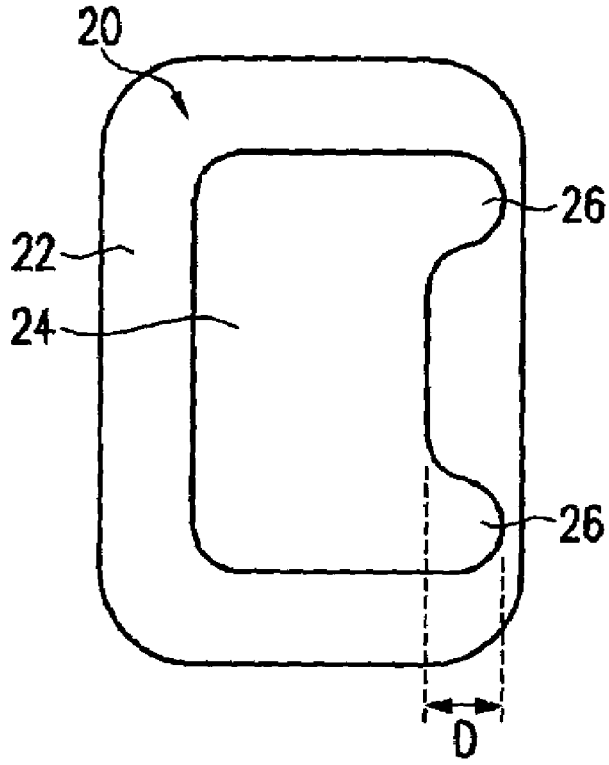
FIG. 6 is a planar view of parts of the shadow mask according to a second exemplary embodiment of the present invention.

In addition, it is also possible for the concave portions 26 to be formed on the two corner portions of the beam passage hole 20 as shown in FIG. 6.

Figure 7:
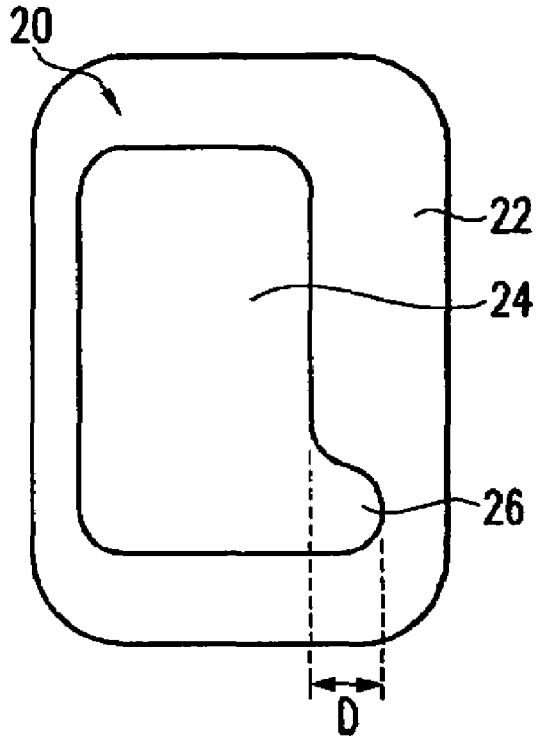
FIG. 7 is a planar view of parts of the shadow mask according to a third exemplary embodiment of the present invention.

The small-sized hole portion 24 can be concentric as shown in FIG. 3 or eccentric as shown in FIG. 7 with the large-sized hole portion 22.

The eccentricity of the small-sized hole portion 24 with respect to the large-sized hole portion 22 is appropriately determined depending upon the deflection angle and the deviation (the spatial distance) of the relevant beam passage hole 20 from the center of the effective screen portion 11. The direction of eccentricity is determined depending upon the location of the beam passage hole 20 when the effective screen portion 11 is divided into the quadrants.

Figure 8:
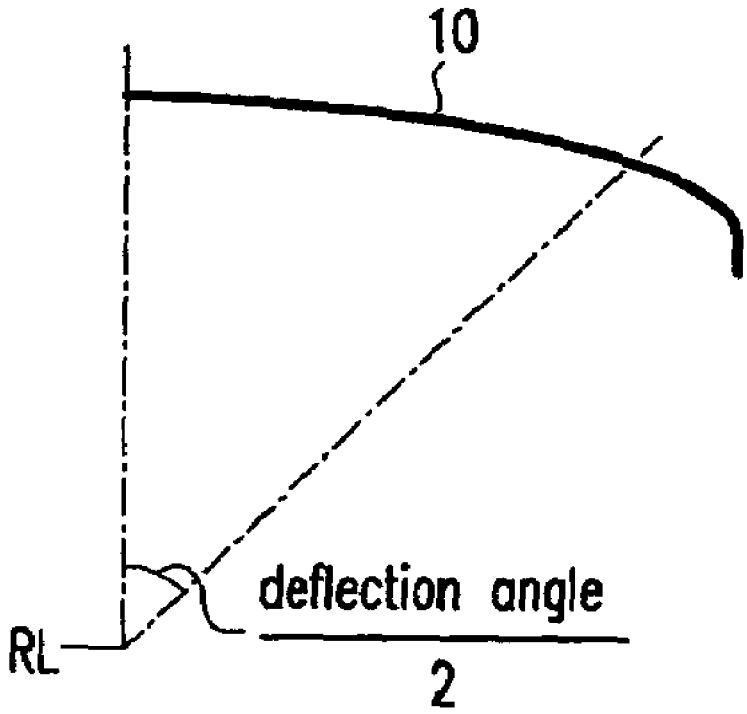
FIG. 8 is a sectional view of the reference line and the deflection angle of the shadow mask.

In FIG. 8, a reference line RL represents the center position of the cone portion of the funnel 4 at which the deflection yoke 5 is installed. If assuming that the reference line RL is an origin and the angle which is formed between the position of the beam passage hole 20 and the axis of the tube is a half of the deflection angle, the light emission area of the phosphors is reduced as measured from the center to the edge of the effective screen portion 11 of the shadow mask 10, as shown in FIG. 9.

Figure 9:
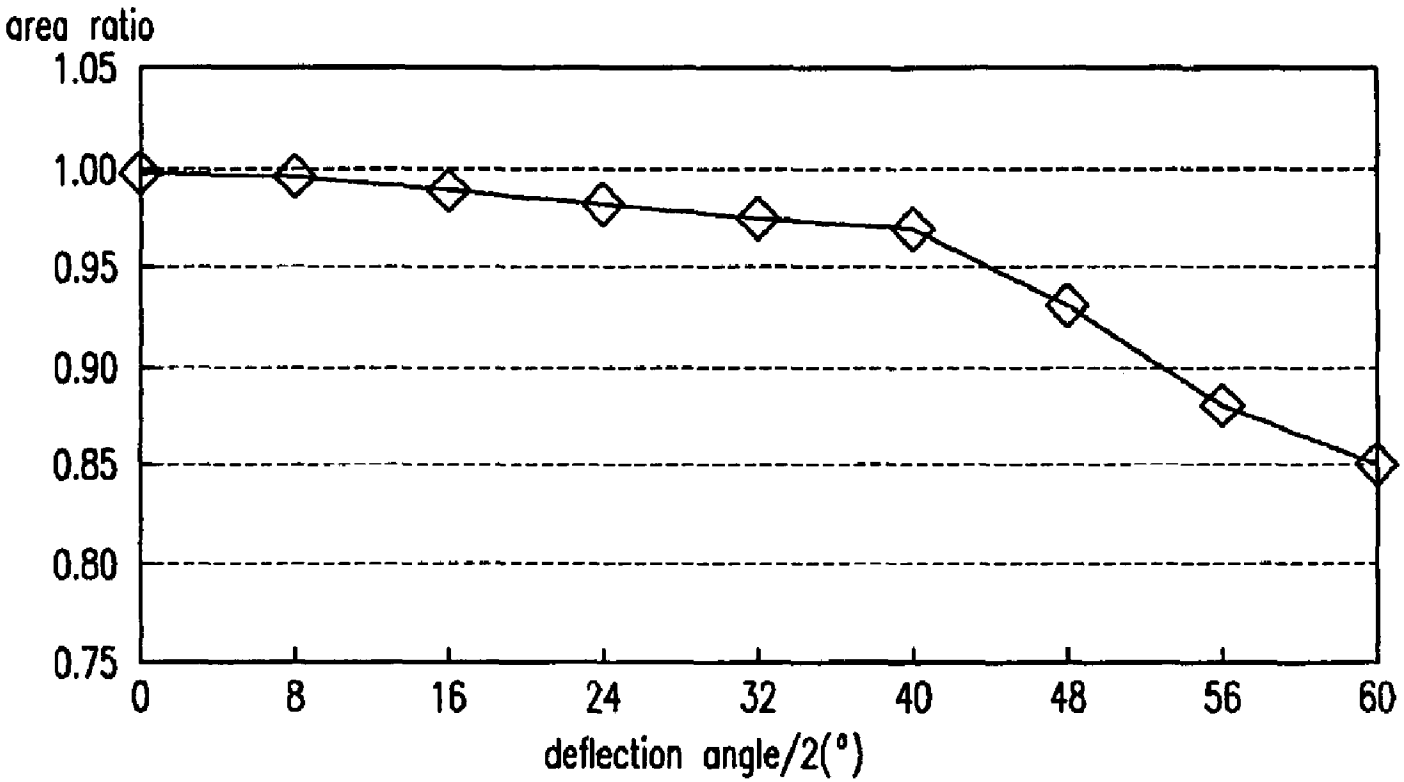
FIG. 9 is a graph of area ratios between the area of the light emission of the phosphors on the center and on the corner of the shadow mask with respect to the spatial distance.

FIG. 9 is a graph of the variation of the ratio of the light emission area according to the deviation from the center of the effective screen portion 11 (an increase of the deflection angle) with respect to the light emission area in the center of the effective screen portion 11.

Herein, the measurement of the light emission area of the phosphors was carried out with a 32 inch CRT, and the beam passage hole 20 was formed in the shape of a rectangle over the effective screen portion 11.

As shown in FIG. 9, the ratio of the light emission area of the phosphors was reduced abruptly when the deflection angle was 40° or more.

Accordingly, we can see that parts of the electron beams collide against the inner surface of the beam passage hole 20 (especially the inner surface on the corner of the beam passage hole 20) and are refracted in incorrect directions as the beam passage hole 20 is deviated from the center of the effective screen portion 11.

This can be confirmed through an analysis of the light emission of the phosphors showing incomplete light emission on a corner of the rectangle.

Accordingly, if the corner portion of the beam passage hole 20 is eliminated, the electron beams pass through the beam passage hole 20 completely. The size of the concave portion 26 can be obtained from the area of the corner portion of the beam passage hole 20 to be eliminated by calculating the area ratio.

As shown in FIG. 3, the size of the concave portion 26 is represented by the serif width D, that is, the vertical distance from the long side edge of the small-sized hole portion 22 to the farthest part of the concave portion 26.

Figure 10:
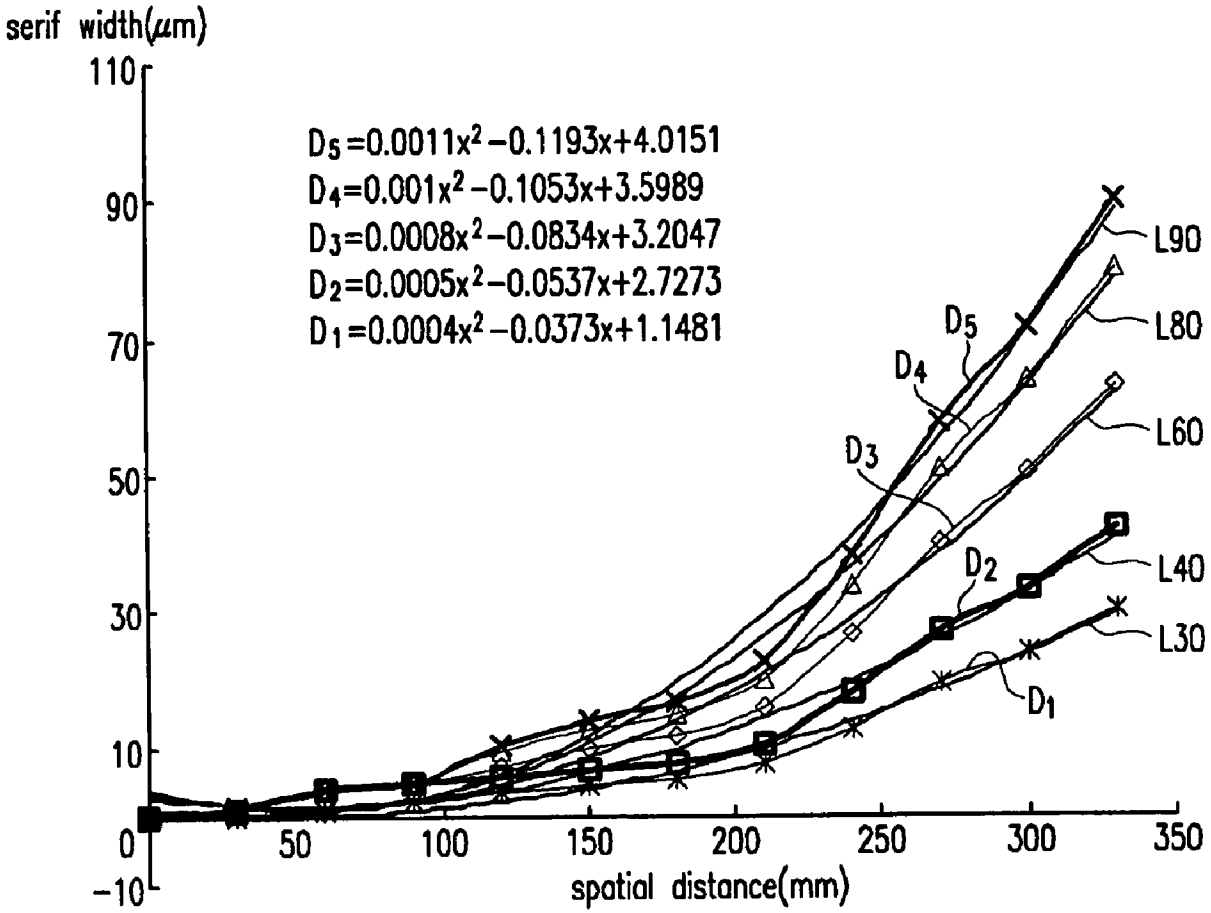
FIG. 10 is a graph of the variation of the serif width according to the spatial distance.

In FIG. 10, the y axis of the graph represents the serif width D and the x axis of the graph represents the diagonal spatial distance from the center of the effective screen portion 11 to the center of the beam passage hole 20.

Each D1, D2, D3, D4, and D5 is an example of the present invention, in the case that the maximum value of the serif width is D is 30 μm, 40 μm, 60 μm, 80 μm, and 90 μm, respectively.

Herein, the maximum value of the serif width D represents the concave portion 26 which is formed in the farthest beam passage hole 20 from the center of the effective screen portion 11, diagonally.

Table 1, corresponding to the graph of FIG. 10, shows the serif width D of the concave portion 26 on each of the spatial distances according to the maximum value of the serif width D.

TABLE 1

| | Serifwidth (D) (μm) | | | | | |
|---|---|---|---|---|---|---|
| | Maximum serif width | 30 | 40 | 60 | 80 | 90 |
| Spatial distance (mm) | 0 | 0 | 0 | 0 | 0 | 0 |
| | 30 | 0 | 1 | 1 | 1 | 1 |
| | 60 | 1 | 4 | 4 | 4 | 4 |
| | 90 | 2 | 5 | 5 | 5 | 5 |
| | 120 | 3 | 6 | 7 | 9 | 10 |
| | 150 | 5 | 7 | 10 | 12 | 14 |
| | 180 | 5 | 8 | 12 | 15 | 16 |
| | 210 | 8 | 11 | 16 | 20 | 23 |
| | 240 | 13 | 18 | 27 | 34 | 38 |
| | 270 | 19 | 27 | 40 | 51 | 58 |
| | 300 | 24 | 34 | 50 | 64 | 72 |

In FIG. 10, L30 is a graph of the function $D_1=0.0004x^2-0.0373x+1.1481$ approximated to a quadratic equation when the maximum value of the serif width D is 30 μm, L40 is a graph of the function $D_2=0.0005x^2-0.0537x+2.7273$ approximated to a quadratic equation when the maximum value of the serif width D is 40 μm, L60 is a graph of the function $D_3=0.0008x^2-0.0834x+3.2047$ approximated to a quadratic equation when the maximum value of the serif width D is 60 μm, L80 is a graph of the function $D_4=0.001x^2-0.1053x+3.5989$ approximated to a quadratic equation when the maximum value of the serif width D is 80 μm, and L90 is a graph of the function $D_5=0.0011\ x^2-0.1193x+4.0151$ approximated to a quadratic equation when the maximum value of the serif width D is 90 μm.

Table 2 shows the absolute value of {c/(b+c)} in each of the cases of the maximum value of the serif width D being 30 μm, 40 μm, 60 μm, 80 μm, and 90 μm when the variation of the serif width D is approximated to the quadratic equation $D=a+bx+cx^2$ (wherein a, b, and c are constants, and x is a spatial distance from the center of the effective screen portion 11 to the center of the beam passage hole 20).

TABLE 2

| Maximum serif width (μm) | Absolute value of {c/(b + c)} |
|---|---|
| 30 | 0.0106 |
| 40 | 0.0092 |
| 60 | 0.0095 |
| 80 | 0.0094 |
| 90 | 0.0091 |

Figure 11:
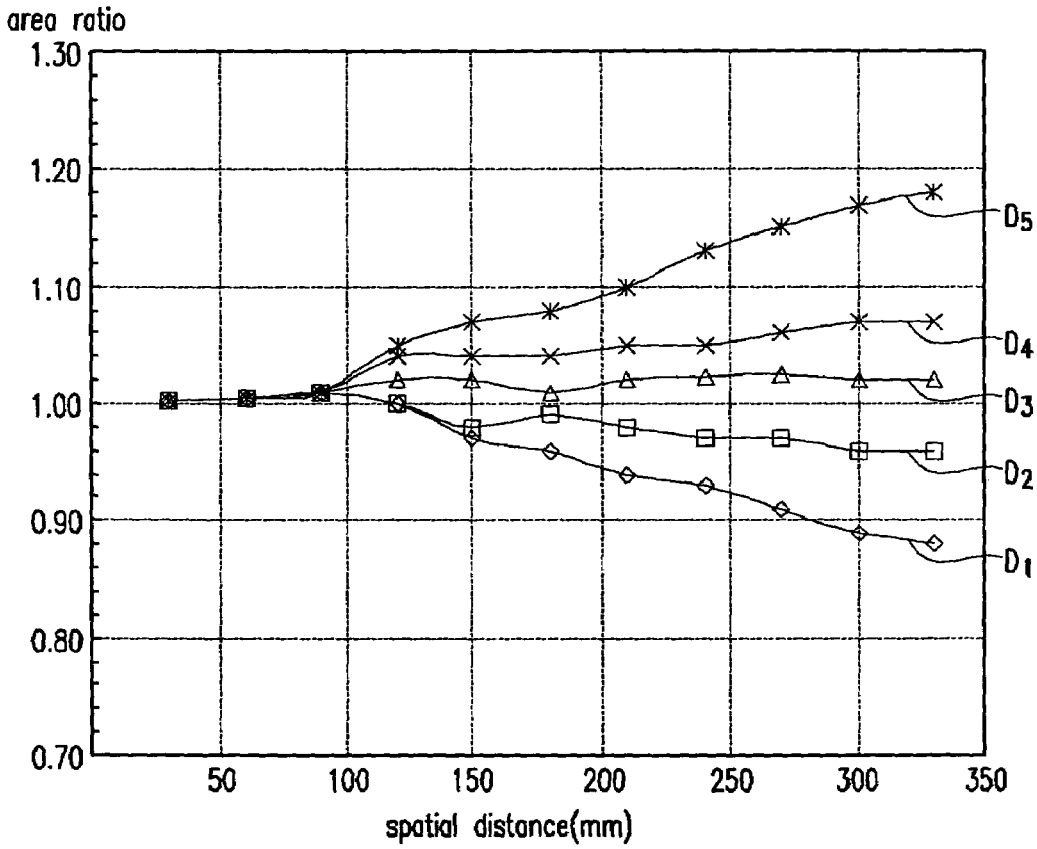
FIG. 11 is a graph of the area ratios of the shadow mask with respect to the present invention according to the spatial distance.

FIG. 11 is a graph of the ratio of the light emission area between the phosphors corresponding to the beam passage hole 20 located at the center of the effective screen portion 11 and the beam passage hole 20 at an arbitrary diagonal spatial distance from it, wherein the x axis represents the spatial distance and the y axis represents the area ratio.

Table 3 shows the relationship between the spatial distance and the area ratio.

TABLE 3

| | Maximum serif width (μm) | 30 | 40 | 60 | 80 | 90 |
|---|---|---|---|---|---|---|
| Spatial distance (mm) | 0 | | | | | |
| | 30 | 1.00 | 1.00 | 1.00 | 1.00 | 1.00 |
| | 60 | 1.01 | 1.01 | 1.01 | 1.01 | 1.01 |
| | 90 | 1.01 | 1.01 | 1.01 | 1.01 | 1.01 |
| | 120 | 1.00 | 1.00 | 1.02 | 1.04 | 1.05 |
| | 150 | 0.97 | 0.98 | 1.02 | 1.04 | 1.07 |
| | 180 | 0.96 | 0.99 | 1.01 | 1.04 | 1.08 |
| | 210 | 0.94 | 0.98 | 1.02 | 1.05 | 1.10 |
| | 240 | 0.93 | 0.97 | 1.02 | 1.05 | 1.13 |
| | 270 | 0.91 | 0.97 | 1.02 | 1.06 | 1.15 |
| | 300 | 0.89 | 0.96 | 1.02 | 1.07 | 1.17 |
| | 330 | 0.88 | 0.96 | 1.02 | 1.07 | 1.18 |

As shown in Table 3 and FIG. 11, when the maximum value of the serif width D is 30 μm and 90 μm, the difference of the area ratio becomes more than 10% as the spatial distance increases. Accordingly, it is desirable to exclude the cases of $D_1$ and $D_5$.

Accordingly, it is desirable to set the absolute value of {c/(b+c)} to be from 0.0091 to 0.0106.

Considering a degree of safety and error, the serif width D of the concave portion 26 corresponds to the quadratic equation $D=a-bx+cx^2$ in which the absolute value of {c/(b+c)} is between 0.0092 and 0.0099.

In particular, the difference of the area ratio is within 2% in the case that the maximum value of the serif width D is 60 μm, and accordingly it is more desirable that the serif width D of the concave portion 26 corresponds to the quadratic equation, $D=a-bx+cx^2$ in which the absolute value of {c/(b+c)} is between 0.0094 and 0.0098.

Since most of the serif widths D corresponding to within 5% of the difference of the area ratio are 10 μm or less, it is desirable that the serif width D of the concave portion 26 on the beam passage hole 20 located on the center of the effective screen portion 11 is maintained at 10 μm or less.

In particular, the shadow mask for a CRT according to the exemplary embodiment of the present invention can be applied to a CRT having a deflection angle of 110° or more for a slim CRT.

The shadow mask for a CRT according to the exemplary embodiment of the present invention can be applied to a CRT which has a panel having a diagonal width of 670 mm or more.

Although exemplary embodiments of the present invention have been described in detail herein, it should be clearly understood that many variations and/or modifications of the basic inventive concept taught herein still fall within the spirit and scope of the present invention, as defined by the appended claims.

What is claimed is:

1. A shadow mask for a Cathode Ray Tube (CRT), comprising:

an effective screen portion including a plurality of beam passage holes arranged in a predetermined pattern; and a non-holed portion surrounding the effective screen portion, the non-holed portion including no beam passage holes;

wherein the beam passage holes have a large-sized hole portion on a side facing a panel of the CRT, and a small-sized hole portion that is smaller than the large-sized hole portion on a side facing an electron gun of the CRT;

wherein a concave portion is arranged on each of the beam passage holes in a direction from a center of the effective screen portion to a direction of emission of the electron gun of the CRT;

wherein the concave portion is varied from the center of the effective screen portion diagonally such that a serif width D of the concave portion satisfies $D=a-bx+cx^2$ (wherein a, b, and c are dimension less constants, and x is a spatial distance from the center of the effective screen portion to a center of the beam passage hole) both D and x being distances; and wherein a, b, and c are selected such that {c/(b+c)} has an absolute value between 0.0092 and 0.0099.

2. The shadow mask for a CRT of claim 1, wherein a, b, and c are selected such that {c/(b+c)} has an absolute value between 0.0094 and 0.0098.

3. The shadow mask for a CRT of claim 1, wherein the serif width of the concave portion located on the center of the effective screen portion is 10 μm or less.

4. A Cathode Ray Tube (CRT), comprising:

a panel having a phosphor film arranged on an inner surface thereof;

a funnel connected to the panel;

a neck connected to the funnel;

an electron gun contained within the neck and adapted to emit electron beams;

a deflection yoke arranged around an outer circumference of the funnel to deflect the electron beams emitted by the electron gun; and a shadow mask arranged within the panel to color-selectively pass the electron beams emitted by the electron gun;

wherein the shadow mask includes an effective screen portion having a plurality of beam passage holes arranged in a predetermined pattern, and a non-holed portion surrounding the effective screen portion and having no beam passage holes;

wherein the beam passage hole has a large-sized hole portion on a side facing the panel, and a small-sized hole portion that is smaller than the large-sized hole portion on a side facing the electron gun;

wherein a concave portion having the shape of a circular arc is arranged on each of the beam passage holes in a direction from a center of the effective screen portion to a direction of emission;

wherein the concave portion is varied from the center of the effective screen portion diagonally such that a serif width D of the concave portion satisfies $D=a-bx+cx^2$ (wherein a, b, and c are dimension less constants, and x is a spatial distance from the center of the effective screen portion to a center of the beam passage hole) both x and D being distances; and a, b, and c selected such that {c/(b+c)}has an absolute value between 0.0092 and 0.0099.

5. The CRT of claim 4, wherein the serif width of the concave portion arranged on the center of the shadow mask is 10 μm or less.

6. The CRT of claim 4, wherein a maximum deflection angle of the electron beam deflected by the deflection yoke is at least 110 degrees.

7. The CRT of claim 4, wherein the panel has a diagonal distance of at least 670 mm.

* * * * *